US009352369B2

(12) United States Patent
Niccolls et al.

(10) Patent No.: US 9,352,369 B2
(45) Date of Patent: May 31, 2016

(54) EQUIPMENT FOR USE IN CORROSIVE ENVIRONMENTS AND METHODS FOR FORMING THEREOF

(71) Applicants: Edwin Hall Niccolls, Danville, CA (US); Grzegorz Jan Kusinski, Moraga, CA (US); David Lawrence Cooke, San Rafael, CA (US)

(72) Inventors: Edwin Hall Niccolls, Danville, CA (US); Grzegorz Jan Kusinski, Moraga, CA (US); David Lawrence Cooke, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 294 days.

(21) Appl. No.: 13/763,137

(22) Filed: Feb. 8, 2013

(65) Prior Publication Data

US 2013/0199045 A1 Aug. 8, 2013

Related U.S. Application Data

(60) Provisional application No. 61/596,343, filed on Feb. 8, 2012.

(51) Int. Cl.

| | |
|---|---|
| ***B21B 3/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/34*** | (2006.01) |

(52) U.S. Cl.

CPC . *B21B 3/00* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/34* (2013.01); *Y10T 29/49616* (2015.01); *Y10T 29/49634* (2015.01)

(58) Field of Classification Search

CPC ..... B21B 3/00; C22C 38/02; C22C 38/04; C22C 38/06; C22C 38/20; C22C 38/22; C22C 38/24; C22C 38/26; C22C 38/34; Y10T 29/49616; Y10T 29/49634

See application file for complete search history.

(56) References Cited

U.S. PATENT DOCUMENTS

| | | | | |
|---|---|---|---|---|
| 3,622,306 | A | 11/1971 | Tanimura | |
| 4,570,708 | A | 2/1986 | Tiberg | |
| 5,817,275 | A | 10/1998 | Ogawa | |
| 2007/0193665 | A1 | 8/2007 | Furuya | |
| 2010/0028705 | A1 | 2/2010 | Keegan | |
| 2011/0315276 | A1* | 12/2011 | Bosch et al. | 148/334 |
| 2014/0017111 | A1* | 1/2014 | Omura et al. | 420/40 |
| 2015/0191809 | A1* | 7/2015 | Hashizume et al. | |

FOREIGN PATENT DOCUMENTS

| | | | |
|---|---|---|---|
| DE | 19982874 | B4 | 11/2005 |
| EP | 1418245 | A2 | 5/2004 |
| JP | H05112844 | A | 5/1993 |
| WO | WO 9614445 | A1 | 5/1996 |

OTHER PUBLICATIONS

PCT Notification of Transmittal of the International Search Report and the Written Opinion of the International Searching Authority or the Declaration regarding PCT/US2013/025382 dated Jun. 4, 2013 (14 pages).

Hou, W., et al.; "Eight-year atmospheric corrosion exposure of steels in China," Corrosion, NACE International, Houston, TX, U.S.; vol. 55, No. 1, Jan. 1, 1999, pp. 65-73.

Blekkenhorst, F., et al; "Development of high strength low alloy steels for marine applications. Part 1: Results of long term exposure tests on commercially available and experimental steels," British Corrosion Journal, London, GB; vol. 21, No. 3, Jan. 1, 1986; pp. 163-176.

* cited by examiner

*Primary Examiner* — Alexander P Taousakis
(74) *Attorney, Agent, or Firm* — Melissa Patangia

(57) ABSTRACT

A method for forming structural equipment employed in sulfur containing environments such as oil refineries and the like. In one embodiment, the method comprises: providing a steel composition containing up to 0.35% of C, 0.30 to 3.5% Si, up to 1.2% Mo, up to 1.35% Mn, up to 5% Al, less than 12.0% Cr, balance of Fe and unavoidable impurities; forming a structural component conforming to prevailing industry standards with respect to design, fabrication, inspection and testing, metallurgical and mechanical properties. The structural equipment has a corrosion rate of less than 15 mpy. In one embodiment, the equipment is formed from a steel composition has a carbon equivalent of less than 0.63, requiring no post weld heat treatment ("PWHT"). In another embodiment, the CE is less than 0.45, requiring no preheat nor PWHT.

20 Claims, No Drawings

EQUIPMENT FOR USE IN CORROSIVE ENVIRONMENTS AND METHODS FOR FORMING THEREOF

CROSS-REFERENCE TO RELATED APPLICATIONS

This application claims benefit under 35 USC 119 of U.S. Provisional Patent Application Nos. 61/596,343 with a filing date of Feb. 8, 2012.

TECHNICAL FIELD

The invention relates generally to structural components such as piping systems, pressure vessels, and the like, for use in corrosive environments, and methods for forming such structural components.

BACKGROUND

In the petroleum industry, levels of sulfur in crude have increased steadily in recent years with the extraction of heavier crude, with some crudes containing up to 5 wt. % sulfur. Sulfur corrosion is a problem in a number of industries. In refineries, crudes and distillate fractions contain $H_2S$ and sulfur species such as mercaptans, disulfides, aliphatic sulfides, etc. (collectively, "sulfur"). It is believed that sulfur species decompose forming $H_2S$, corroding equipment and/or causing severe damages to equipment including sulfide stress cracking (SSC), hydrogen induced cracking (HIC), stress oriented hydrogen induced cracking (SOHIC). Sulfur corrosion also affects the power industry in the burning of fossil fuels to generate energy, and in the operation of wet scrubbers to remove pollutants from furnace flue gas or other gas streams.

Industry task groups have been formed to provide guidelines to avoid corrosion. The Corrosion Society group NACE ("National Association of Corrosion Engineers") published a document in 2004 (NACE 34103), the contents of which are incorporated by reference herein, indicating that lower than 5% Cr steels are not currently used in refineries to avoid sulfidic corrosion, 5Cr steels are used up to 343° C., and 9Cr steel are used up to 400° C. 300-series austenitic stainless steels, commonly known as "18-8" (roughly 18 Cr-8 Ni) alloys, are indicated to have a high degree of resistance to sulfidic corrosion.

After the 2004 publication of the Corrosion Society group NACE, the API Subcommittee on Corrosion and Materials also issued guidelines for avoiding sulfidation corrosion (API Recommend Practice 939-C Guidelines for Avoiding Sulfidation (Sulfidic) Corrosion Failures in Oil Refineries, First Edition), the contents of which are incorporated by reference herein. It is indicated that sulfidic corrosion rate increases with temperature from 230° C. until 425° C., at approximately which point the corrosion rate reaches a peak.

As in the NACE findings, the API Subcommittee found chromium to be a beneficial alloying element protecting against corrosion, e.g., the corrosion rate of steel with 5% Cr is lower than the corrosion rate of carbon steel. In general, the ranking of steels and alloys with respect to corrosion resistance, particularly sulfidation corrosion, ranges according to the following order from low to high: carbon steel (ASTM A53), carbon steel (ASTM A106), carbon steel plus 0.5% Mo; 5 Cr steel+0.5% Mo; and 300-series austenitic stainless steels.

In general, the Committee findings acknowledge an improvement in sulfidation resistance with the addition of Si of up to 0.25% to carbon steel containing no Si. It is indicated that the Si effect plateaus out after the amount is reached. There are other references disclosing the addition of higher Si amounts. US Patent Application No. 20110315276 discloses a low alloy steel with a high yield strength and excellent sulphide stress cracking ("SSC") properties, for use in tubular products for hydrocarbon wells containing hydrogen sulphide ($H_2S$). Si is added for deoxidation purpose. However, the reference teaches that "beyond 0.5%, it results in deterioration of SSC resistance. For this reason, its content is fixed to between 0.1% and 0.5%."

In a 1987 paper, Cihal et al. conducted a study on sulphidic corrosion of austenitic corrosion resisting steel containing 20% Cr, 20% Ni and various levels of Si and P (0.09% to 5.4% Si). It was indicated that the highest resistance to sulphide corrosion was recorded for the steel with the low content of Si, P and S. Furthermore, "[t]he sensitivity to sulfide corrosion cracking increases with increasing silicon content." (See "Sulphide Corrosion Cracking of Corrosion Resisting Steels with Various Silicon Content," Kovove Materialy, Vol. 27, 1987, No. 4, pp. 399-407).

There is still a need for a new class of materials for equipment subject to corrosion and stress cracking in sulfur containing environments.

SUMMARY OF THE INVENTION

In one aspect, the invention relates to a corrosion resistant pipe for use in a sulfur-containing environment. The pipe comprises a carbon steel composition based on weight: up to 0.35% of C; from 0.30 to 3.5% Si; up to 0.15% Mo; up to 1.35% Mn; up to 5% Al; one or more elements selected from Cr, Cu, Ni, and Cr in an amount of less than 0.4% each; a total concentration of Cr, Cu, Mo, Ni, and V of up to 1%; balance of Fe and unavoidable impurities. The pipe complies with at least one of ASTM and API standards with respect to manufacture, dimensions and weight, mechanical properties, testing, and certification. The pipe has a corrosion rate of at most 15 mpy upon exposure to hydrocarbons saturated with a gas stream containing 10% $H_2S$ and 90% nitrogen at 600° F. for 72 hours. In one embodiment, the pipe comprises a carbon steel composition having 0.3% to 1.5% Si by weight. In another embodiment, the pipe comprises a carbon steel composition having a carbon equivalent ("CE") of less than 0.63 requiring no post weld heat treatment (PWHT). In another embodiment, the CE is less than 0.45 requiring no pre-heat treatment nor PWHT.

In another aspect, the pipe comprises a steel composition having chemical requirements as specified according to at least one of ASTM and API standards, modified by adding at least 0.05% Si to the chemical requirements for a Si content ranging from 0.30 to 3.5% by weight. The pipe complies to the at least one of ASTM and API standards with respect to manufacture, dimensions and weight, mechanical properties, testing, and certification. Upon exposure to hydrocarbons saturated with a gas stream containing 10% $H_2S$ and 90% nitrogen at 600° F. for 72 hours, the pipe has a corrosion rate of at least 25% less than a pipe having chemical requirements as specified according to the at least one of ASTM and API standards and without addition to the chemical requirements for Si. In one embodiment, the pipe comprises an alloy steel composition having between 4 to 12% Cr. In another embodiment, the pipe comprises an alloy steel composition having chemical requirements as specified according to any of ASTM A-335 and ASTM A-387.

In one aspect, the invention relates to a method for making an as-welded steel pipe for use in a sulfur-containing environment. The method comprises: forming a cast steel slab, the steel having as components in weight: up to 0.35% of C; from 0.30 to 3.5% Si; up to 0.15% Mo; up to 1.35% Mn; up to 5% Al; one or more elements selected from Cr, Cu, Ni, and Cr in an amount of up to 0.4% each; a total concentration of Cr, Cu, Mo, Ni, and V of up to 1%; balance of Fe and unavoidable impurities; heating the steel slab to a temperature in excess of 2000° F.; rolling a heated steel slab in a rolling mill to obtain a skelp having a desired thickness; forming the skelp into a pipe having two side edges positioned in contact with one another; and welding the two side edges together to form an as-welded pipe. The as-welded pipe complies with at least one of ASTM and API standards with respect to manufacture, dimensions and weight, mechanical properties, testing, and certification. The pipe upon exposure to hydrocarbons saturated with a gas stream containing 10% $H_2S$ and 90% nitrogen at 600° F. for 72 hours, the pipe has a corrosion rate of less than 15 mpy.

In yet another aspect, the invention relates to a corrosion resistant pressure vessel for use in a sulfur-containing environment. The pressure vessel comprises a carbon steel composition based on weight: up to 0.35% of C; from 0.30 to 3.5% Si; up to 0.15% Mo; up to 1.35% Mn; up to 5% Al; one or more elements selected from Cr, Cu, Ni, and Cr in an amount of less than 0.4% each; a total concentration of Cr, Cu, Mo, Ni, and V of up to 1%; balance of Fe and unavoidable impurities. The pressure vessel complies with at least one of ASME Boiler and Pressure Vessel Code, Pressure Equipment Directive of the European Union, Japanese Industrial Standard and Canadian Standard CSA B51 with respect to manufacture, dimensions and weight, mechanical properties, testing, and certification. The pressure vessel has a corrosion rate of less than 15 mpy upon exposure to hydrocarbons saturated with a gas stream containing 10% $H_2S$ and 90% nitrogen at 600° F. for 72 hours.

In another aspect, the pressure vessel comprises a steel composition having chemical requirements as specified according to at least one of ASTM and API standards, modified by adding at least 0.05% Si to the chemical requirements for a Si content ranging from 0.30 to 3.5% by weight. The pressure vessel complies to the at least one of ASME Boiler and Pressure Vessel Code, Pressure Equipment Directive of the European Union, Japanese Industrial Standard and Canadian Standard CSA B51 with respect to manufacture, dimensions and weight, mechanical properties, testing, and certification. Upon exposure to hydrocarbons saturated with a gas stream containing 10% $H_2S$ and 90% nitrogen at 600° F. for 72 hours, the pressure vessel has a corrosion rate of at least 25% less than a pressure vessel having chemical requirements as specified according to the at least one of ASTM and API standards and without addition to the chemical requirements for Si.

In yet another aspect, the pressure vessel comprising a steel composition based on weight: up to 0.35% of C; 0.30 to 3.5% Si; up to 1.2% Mo; up to 1.35% Mn; up to 5% Al; less than 12.0% Cr; balance of Fe and unavoidable impurities. The pressure vessel complies with at least one of ASME Boiler and Pressure Vessel Code, Pressure Equipment Directive of the European Union, Japanese Industrial Standard and Canadian Standard CSA B51 with respect to manufacture, dimensions and weight, mechanical properties, testing, and certification. Upon exposure to hydrocarbons saturated with a gas stream containing 10% $H_2S$ and 90% nitrogen at 600° F. for 72 hours, the pressure vessel has a corrosion rate of at most 15 mpy.

In one aspect, the invention relates to a method for making an as-welded steel pipe for use in a sulfur-containing environment. The method comprises the steps: forming a cast steel slab, the steel having chemical requirements as specified according to any of ASTM A106 and ASTM A36 standards and modified by adding at least 0.05% Si to the Si chemical requirements specified in the standard for an Si concentration of at least 0.30%; heating the steel slab to a temperature in excess of 2000° F.; rolling a heated steel slab in a rolling mill to obtain a skelp having a desired thickness; forming the skelp into a pipe having two side edges positioned in contact with one another; and welding the two side edges together to form an as-welded pipe; wherein the as-welded pipe complies to any of the standard with respect to manufacture, dimensions and weight, mechanical properties, testing, and certification; and upon exposure to hydrocarbons saturated with a gas stream containing 10% $H_2S$ and 90% nitrogen at 600° F. for 72 hours, the pipe has a corrosion rate of less than 15 mpy.

In yet another aspect, the invention relates to a method for making a seamless steel pipe for use in a sulfur-containing environment. In the method, first a billet is formed, the billet having as components in weight: up to 0.35% of C; from 0.30 to 3.5% Si; up to 0.15% Mo; up to 1.35% Mn; up to 5% Al; one or more elements selected from Cr, Cu, and Ni in an amount of up to 0.4% each; a total concentration of Cr, Cu, Mo, Ni, and V of up to 1%; balance of Fe and unavoidable impurities. In the subsequent steps, the billet is subjected to a piercing operation to form a hollow shell; the hollow shell is then rolled forming the seamless steel pipe. The pipe upon exposure to hydrocarbons saturated with a gas stream containing 10% $H_2S$ and 90% nitrogen at 600° F. for 72 hours, has a corrosion rate of less than 15 mpy.

DESCRIPTION

The following terms will be used throughout the specification and will have the following meanings unless otherwise indicated.

"mpy" means mil per year in terms of corrosion rate (1 mpy=0.0254 mm/year=25.4 micro-m/year). The corrosion rate is computed based on metal loss of mm/y=87.6×(W/DAT), wherein W is weight loss in milligrams; D is the metal density in g/cm$^3$; A is the area of sample; and T is exposure time of the sample in corrosive medium in hours. When used to indicate the corrosion of equipment, "mpy" refers to the average corrosion rate across the equipment and affecting the thickness of the equipment. For example, a 3" Schedule 80 pipe having a corrosion rate of 12.2 mpy would produce an average thickness of 0.08" after 18 years in service, with some sections of the pipe with less than or more than 0.08" thick.

"CE" refers to "carbon equivalent," which is an empirical measure of weldability in steels, used to guide the alloying/alloy selection if post-weld heat treatment needs to be avoided due to cost considerations. CE (in %) is computed as follows:

$$CE=\%\ C+(\%\ Mn+\%\ Si)/6+(\%\ Cr+\%\ Mo+\%\ V)/5+(\%\ Ni+\%\ Cu)/15.$$

"Sulfur" refers to elemental sulfur by itself, $H_2S$, as well as sulfur-containing species such as mercaptans, disulfides, aliphatic sulfides, aliphatic disulfides, polysulfides, thiophenes, etc.

"Sulfur-containing environments" in one embodiment refers to environments equivalent to exposure to hydrocarbons containing typically at least 0.1 wt. % sulfur for at least 30% of the time, and operating at a temperature ranging from ambient to 1000° F., e.g., oil production, oil refining, oil exploration, chemicals, energy generation, sulfur reduction or removal equipment. In another embodiment, sulfur-containing environments refer to applications defined in API Recommend Practice 939-C section 5, "Location of Sulfidation Corrosion," including equipment that experience high corrosion rates due to sulfur even at concentrations as low as 1 ppm as in hydrogen-free, low sulfur streams of hydrotreater distillations sections.

"Hydrocarbons" refers to a pure compound or mixtures of compounds containing hydrogen and carbon, and optionally with sulfur, nitrogen, oxygen, and other elements. Examples include but are not limited to crude petroleum, synthetic crude oils, petroleum products such as gasoline, jet fuel, diesel fuel, lubricant base oil, solvents, paraffin waxes, asphaltenes, and alcohols such as methanol and ethanol.

"Preheat treatment" refers to a process where the work piece, e.g., a pipe, is preheated prior to welding to a temperature of about 200-700° F., especially with steel compositions with a CE of greater than 0.45, to prevent the potential for cracking in the heat affected zones of flame cut edges and/or welds.

"Post weld heat treatment" or "PWHT" refers to a process especially for steel compositions with a CE of >0.63, in which a work piece is heated after welding to a temperature below the lower transformation temperature at a controlled rate for a specific amount of time (e.g., 1 hour per inch of thickness, 1 hr minimum), then cooling at a controlled rate, resulting in a modification of both the microstructure of the weld metal as well as the heat affected zone.

"Structural equipment" refers to piping systems, vessels, and the like. A reference to any of structural equipment, pipes, piping systems, vessels, plates for vessels, also includes mechanical couplings for joining the structural equipment, e.g., fluid control components such as valves, valve stems, pumps, pump shafts, reducers, strainers, restrictors, pressure regulators and the like, as well as pipe stock, pipe fittings such as elbows, caps, tees, and the like. A reference to pipes also include tubing.

"Free of chromium," "essentially free of chromium" or "substantially free of chromium" means that in production of the steel composition, no chromium Cr will be deliberately added. Traces chromium can be present. Generally, however, the amount of chromium if any is less than 0.01 wt. %.

"Steel" refers to iron to which between 0.02 to 1.7% carbon has been added (http://www.newworldencyclopedia.org/entry/Alloy).

"Alloy steel" refers to steel that is alloyed with a variety of elements in total amounts between 1.0% and 50% by weight to improve its mechanical properties.

"Low alloy steel" refers to steel that is alloyed with a variety of elements in total amounts between 1.0% and 8% by weight.

"Silicon steel," also known as "electrical steel" or "relay steel," refers to a steel containing silicon of up to 6.5% (http://en.wikipedia.org/wiki/Electrical_steel).

Silicon steel has been used in the past primarily for electrical applications (thus the name "electrical steel") and electromechanical devices such as relays, solenoids, transformers, electrical motors, fluorescent lamp ballasts, electricity meters, hermetic motors for refrigerators, and the like. These applications require materials with high electrical resistivity, high permeability, good magnetic properties in all directions—and a low cost. Resistivity property, which is low in iron, increases markedly with the addition of silicon.

Carbon steel has been widely used in the oil and gas industry for refining and upstream (i.e., exploration and production) applications at both high and low temperatures in applications such as piping, downhole tubulars, pressure vessels, etc., as long as the conditions are not too corrosive. For corrosive conditions, alloy steels are used, which are expensive and require cost/care in fabrication primarily due to welding issues such as the need for post weld heat treatment after welds are made. In some cases, particularly at lower temperatures, corrosion inhibitors are used to help mitigate the corrosion in carbon steel as well as alloy steels.

Commercial grades of carbon steel typically contain less than 0.2% Si. In one aspect, the invention relates to specifically adding silicon to carbon steel to enhance the corrosion resistant properties, e.g., using a Si-modified carbon steel or silicon steel as structural equipment in sulfur containing environments. The invention relates to new alloy compositions with a low Cr concentration, by adding Si for a concentration of 0.3 to 3.5 wt. % in one embodiment and up to 1 wt. % Si in a second embodiment, to improve corrosion resistant properties in sulfur-containing environments. In another aspect, the invention relates to the addition of silicon to welding consumables (e.g., electrodes, etc.) used in the welding of structural equipment in sulfur containing environments, for a concentration of 0.3 to 3.5 wt. % Si in one embodiment and up to 1 wt. % Si in a second embodiment. Si is essentially the same cost as iron used as the basis for carbon steel, thus the increase in material cost is insignificant.

In one embodiment, the structural equipment with increased sulfur resistance is a pipe product for use in sulfur-containing environments, e.g., as a pipe for containing/carrying crude oil, a well casing for lining an oil or gas well to enable extraction of the oil or gas therefrom, transfer piping, crude unit piping, down hole tubulars and ancillary equipment, high pressure flow lines and pipes, pipes for deep sour wells ($H_2S$), pipes and tubing for drilling, production and transport from offshore wells and deep wells.

In another embodiment, the structural equipment is a pressure vessel, e.g., tank, column, etc. The pressure vessel can be of any shape as required for the application, e.g., spheres, cylinders, etc. Examples of pressure vessel include but are not limited to fired boiler, fired heater, mixing tank, amine contactors, amine generators, flare knock out pot, separators, waste heat boilers, sulfur surge vessels, sulfreen reactors, regeneration gas coolers, steam drums, desalters, waste heat boilers in hydrogen plants, furnace heater casing, flares and stacks, sour water strippers, vessels for amine and $H_2S$ containment, fractionators, pump cases, flue gas scrubbers, and stack.

Compositions of the Structural Equipment:

The structural equipment for use in sulfur-containing environments can be constructed out of a steel composition without the need for high levels of alloying elements such as Cr, Mo, and Ni in the prior art, and with less than any of 12% Cr, 5% Ni, and 5% Mo. Depending on the applications, the structural equipment for use in sulfur-containing environments can be constructed partially or fully out of silicon steel type compositions (by modifying commercial grade carbon steel with the addition of Si), or alloy steel compositions with less than 12% Cr and modified with the addition of Si.

The composition is a modified carbon steel with the modification being a sufficient amount of Si for the Si content to be in the range of 0.30-3.5 wt. % in one embodiment and 0.30-1 wt. % in a second embodiment, thus providing the corrosion-resistant characteristics needed for sulfur-containing environments operating at a temperature ranging from 400° F. to 1000° F. In one embodiment, the composition is a modification of carbon steel standard being widely used in for various applications, e.g., ASTM A36 for carbon steel pipes; ASTM A106 is for high temperature service; ASTM A537 for carbon steel plates for pressure vessels, etc. Carbon steel is typically used in refineries, as the material is suitable for welding, bending, flanging and similar forming operations.

The Si addition is at least 0.05 wt. % above the commercially specified Si content for equipment in sulfur containing environment in one embodiment for a Si level of up to 3.5 wt. %; and at least 0.25 wt. % above the commercially available specified Si content in a second embodiment. In one embodiment, the maximum Si content is kept at about 1 wt. %. In a second embodiment, the maximum Si content is maintained at 2 wt. %. In a third embodiment, at most 2.5 wt. %.

In one embodiment, the Si addition is sufficient for a Si level of above 0.30% but sufficiently small enough for little or no impact on fabrication with a CE of 0.45 or less, for the material to weld just as conventional carbon steel. In another embodiment, the Si level is above 0.3% but sufficient high enough for the desired corrosion resistance rate, and modest fabrication impact with a CE of >0.45 but less than 0.63. For this CE range, preheat is needed prior to welding but no PWHT. In yet another embodiment with higher levels of Si and optionally with the addition of Cr for substantially better corrosion resistance protection, fabrication requirement as in the prior art with PWHT but for a much less expensive material than the conventional chrome alloys of the prior art.

In one embodiment, the equipment comprises a carbon steel composition having components in weight % of: up to 0.35% of C; from 0.30 to 3.5% Si; up to 0.15% Mo; up to 1.35% Mn; up to 5% Al; one or more elements selected from Cr, Cu, Ni, and Cr in an amount of less than 0.4% each; and a total concentration of Cr, Cu, Mo, Ni, and V of up to 1%. In another embodiment, the carbon steel compositions are as shown in Table 1 in wt. %, which compositions are modifications of ASTM/API grades with the addition of Si. Standard ASTM/API Si levels are also included for comparative purpose.

TABLE 1

| Component wt. % | Modified ASTM A106 | Modified ASTM A36 | Modified ASTM A537 |
|---|---|---|---|
| Fe | bal | bal | bal |
| C max | 0.35* | 0.26* | 0.24 |
| Si | 0.3-3.5 | 0.3-3.5 | 0.3-3.5 |
| Mo max | 0.15 | — | — |
| Cr max | 0.4 | — | — |
| Mn max | 0.29-1.06** | 1.35** | 1.46** |
| P max | 0.035 | 0.04 | 0.035 |
| S max | 0.035 | 0.05 | 0.035 |
| Cu max | 0.4 | 0.20 ϑ | 0.35 |
| Ni max | 0.4 | — | .25*** |
| V max | 0.08 | — | — |
| Al max | 5.0 ϵ | 5.0 ϵ | 5.0 ϵ |
| Cr, Cu, Mo, Ni, V total | <1 wt. % | — | — |
| Si level per standard | 0.20 max ϟ | 0.4 max Δ | 0.15-0.5 |

ϵ The standards do not specify limit for Al.

ϟ Although ASTM A106 does not specify a max limit for Si, prior art concentrations for structural equipment according to ASTM 106 specifications has Si content of <0.2 wt %.

ϑ minimum Cu % when copper steel is specified.

* and **For each reduction of 0.01% below the maximum C level, an increase in Mn of 0.05% is permitted up to 1.35%. For ASTM A537, Mn level may go up to 1.6% if CE is less than 0.57.

***Ni level may go up to 0.5% if CE is less than 0.57.

Δ Si content of 0.15 to 0.40 is required for shapes with >3" thick flanges.

In one embodiment, the carbon steel composition modified with Si addition is essentially free of Cr, while still providing the equipment with excellent corrosion resistance in sulfur-containing environments comparable to compositions in the prior art with higher Cr levels, e.g., at least 1%. In another embodiment, the Si-modified carbon steel composition has a Cr concentration of less than 0.4%. In yet another embodiment, the Al concentration is 2% or less.

In another embodiment, the equipment for use in sulfur-containing environment comprises a modified alloy steel from a standard specification, with the modification to the standard chemical requirements being the addition of Si for the alloy steel to have a Si concentration ranging from 0.3 to 3.5 wt. %. The alloy steel in one embodiment is according to any of ASTM and/or API standards for structural equipment, including but not limited to A387, "Standard Specification for Pressure Vessel Plates, Alloy Steel, Chromium Molybdenum," and ASTM A335, "Standard Specification for Seamless Ferritic Alloy-Steel Pipe for High-Temperature Service." Theses specifications cover Cr-alloy steel intended for elevated temperature service. Examples include but are not limited to ASTM/ASME A335/SA335 P2, P5, P11, P22, P23, P5, P91, and P92.

In one embodiment, the modified alloy steel is by modifying any of 5-Cr, 9-Cr, 12-Cr grades in ASTM A335 and ASTM-A387, with the addition of Si to the Cr alloy steel being sufficient for the composition to have a Si content ranging from 0.3 to 3.5 wt. % Si. The addition of Si provides the alloy steel the sulfur corrosion resistant characteristics of an alloy steel having a higher Cr content. For example, the addition of 0.05 to 1.5% Si to a 5-Cr alloy provides the 5-Cr alloy with the sulfur corrosion resistant characteristics of a 9-Cr alloy; and the addition of 0.25 to 1.5% Si to a 9-Cr alloy provides the 9-Cr alloy with the sulfur corrosion resistant characteristics of a 12.5 Cr SS (or SS Grade 440 with 0.5% C, 11.5-13.5% Cr, >0.75% Ni, <1% Mn, <1% Si, 0.04% P, <0.03% S, balance Fe). Providing the sulfur corrosion characteristics means that the corrosion rate of the Si-modified alloy steel is within 15% (lower or higher) of the comparative corrosion rate in mpy.

In one embodiment, the equipment comprises an alloy steel composition having components in weight % of: up to 0.35% of C; from 0.30 to 3.5% Si; up to 1.2% Mo; up to 1.35% Mn; up to 5% Al; and from 4.0 to 12.0% Cr. In another embodiment, the alloy steel composition is a modified alloy steel grade according to ASTM A335 and ASTM-A387 as shown in Table 2, with the modification being a higher Si concentration than specified under the standards. The Si concentration as specified in the standards is also included for comparative purpose.

TABLE 2

| Component wt. %/ Si-modified Grade | A335 P-5 | A335 P-5b | A335 P-9 | A335 P-122 | A3 87 Grade 9 |
|---|---|---|---|---|---|
| C | 0.15 max | 0.15 max | 0.15 max | 0.15 max | 0.15 max |
| Mn | .30-.60 | 30-.60 | 30-.60 | 0.7 max | 0.30-0.60 |
| P, max | 0.025 | 0.025 | 0.025 | 0.02 | 0.02 |
| S, max | 0.025 | 0.025 | 0.025 | 0.01 | 0.025 |
| Si | 0.75-3.5 | 1.25-3.50 | 0.50-3.5 | 0.75-3.5 | 1.25-3.5 |
| Cr | 4.0-6.0 | 4.0-6.0 | 8.0-10.0 | 10.0-11.5 | 8.0-10.0 |
| Mo | 0.45-0.65 | 0.45-0.65 | 0.90-1.1 | 0.25-0.60 | 0.9-1.10 |
| comparative Si per standard | 0.50 max | 1.0-2.0 | 0.25-1.0 | 0.50 max | 1.0 max |

In one embodiment, the corrosion resistant composition is a modification of a high-strength steel composition as disclosed in US Patent Publication No. 2007/0267110, included herein by reference in its entirety, with the modification being an increase in the Si content from the specified level of 0.26 to 0.34 wt. % to at least 0.5 wt. %, and preferably up to 2.5 wt. %.

In another embodiment, the corrosion resistant composition is a modification of the low alloy steel with high yield strength and high sulfide stress cracking resistant (SSC-resistant) as disclosed in US Patent Publication No. 2011/0315276, the disclosure included herein by reference in its entirety. The modification comprises adding Si to the specified Si level of 0.5%, for a level of 0.75 to 2.5% Si, for a composition with 0.3-0.5% C; 0.75 to 2.5% Si; 0.1 to 1% Mn; less than 0.03% P; less than 0.005% S; 0.3 to 1.5% Cr; 1 to 1.5% Mo; 0.01 to 0.1% Al; 0.03 to 0.06% V; 0.04 to 0.15% Nb; up to 0.015% Ti; and the balance being Fe. In one embodiment, the Al level is increased to a level of 0.5 to 5%.

The Si-modified composition in one embodiment is greater than 0.3% but sufficiently low enough for a CE of 0.45 or less for better weldability, avoiding the need for preheat before welding. The Si-modified composition in one embodiment contains less than 1.5 wt. % Si and with a CE of 0.63 or less, as higher the CE the higher the hardness in the weld seam after welding. The maximum hardness allowed in a pipe after welding is approximately 250 Vickers, which corresponds to a CE of 0.6. Any weldments with a CE higher than 0.6 require a post weld heat treatment (PWHT) before the equipment is put into service.

In one embodiment, the Si-modified composition contains 0.3 to 3.5 wt. % Si and with a CE greater than 0.63, which requires PWHT. PWHT is also employed in embodiments wherein the composition has a microhardness which exceeds the API spec limit of 250 HV for Si levels>1.3%, PWHT helps reduce the hardness to within spec.

In one embodiment, the Si-modified composition further contains 0.2 to 5% Al. In another embodiment, the Al addition is kept below 2% to minimize problems with discontinuities in the coating (e.g., bare spots).

Method for Forming Equipment for Sulfur-Containing Environments:

In the form of a pipe, the structural equipment is manufactured according to the specifications as required in the prevailing industry standards for the application with respect to manufacture, dimensions and weight, workmanship, finish, appearance, properties and product testing, certification, and product analysis; employing a carbon steel or alloy steel composition with a Si content of at least 0.30 to 3.5 wt. % in one embodiment, from 0.30 to 1.0 wt. % in a second embodiment; and up to 2.5 wt. % in a third embodiment, to provide the necessary corrosion protection for the equipment. Industry standards with respect to physical dimensions include but are not limited to wall thickness, inside and outside diameters, external surface, etc. Standards with respect to properties and product testing include but are not limited to metallurgical properties, mechanical properties, etc., to assure the performance, safety, protection, and certification required for the application. For example, as-welded steel casing products for in the oil and gas industry must have a minimum yield strength ranging from 40 ksi (276 MPa) to 80 ksi (552 MPa). For deep well applications, pipes or as-welded steel casing products must have a minimum yield strength in excess of 80 ksi (552 MPa).

The pipe is manufactured according to the prevailing industry standards according to at least one of API (such as API Spec 5L $4^{th}$ edition), ASTM, DIN, ISO, NFA, EN, EEMUA, DNV, GOST, and modified with respect to the chemical composition requirements with the addition of Si of at least 0.05 wt. % to the Si concentration specified in the chemical requirements, for a Si concentration of 0.30 to 3.5 wt. % in one embodiment, and from 0.30 to 1.0 wt. % in a second embodiment. In one embodiment, the pipe with the Si-modified composition is manufactured according to ASTM A106 seamless carbon steel pipe for high-temperature service tools. In another embodiment, the standard is ASTM A53 Steel Pipe Grade Supplies for the oil and gas industries.

The structural equipment in the form of a pressure vessel is constructed according to according to the appropriate industry standards. For example, in the manufacture of a cylindrical or spherical pressure vessel, rolled and/or forged parts are welded together. Seamless pipe can also be used to manufacture a pressure vessel albeit small-sized. Subsequently, to produce the vessel, end caps are welded to each end of the container by any suitable technology, including but not limited to SMAW (submerged metal arc welding), friction welding, gas tungsten arc welding or laser welding. In one embodiment, the construction of the pressure vessel is according to at least one of prevailing design standards such as the ASME Boiler and Pressure Vessel Code, the Pressure Equipment Directive of the European Union (PED), the Japanese Industrial Standard (JIS), the Canadian Standard CSA B51 and other international standards. Standards such as the ASME Code provide for the mandatory requirements, specific prohibitions and non-mandatory guidance for materials, design, fabrication, inspection and testing, markings and reports, overpressure protection and certification. Examples of the requirements include minimum tolerances, thicknesses, design stress values, tensile and yield stress values for the vessel and material properties, e.g., modulus of elasticity, coefficient of heat transfer, etc.

The structural equipment in the form of a pipe product can be: welded pipe formed from hot-rolled steel (skelp) which has been fashioned into a tube, having a straight longitudinal weld (also referred to as "as-welded" or "as-rolled" pipe); and seamless pipe produced by subjecting a steel billet to a piercing operation followed by a rolling or stretch-forming operation (also referred to as "as-formed" pipe).

In one embodiment to form a welded pipe, a cast steel slab comprising the composition with a Si content ranging from 0.3 to 3.5 wt. % Si is formed. The steel slab is heated to a temperature in excess of 2000° F., e.g., approximately 2300° F., then hot-rolled at a temperature of approximately 1500° F. to obtain a skelp having a desired thickness. The skelp is slit or sized longitudinally to a width corresponding to the desired circumference of the pipe. The sized skelp is passed progressively through a series of rolls to form a round tube with two edges. The edges are then welded together using welding processes known in the art, e.g., ERW.

In one embodiment wherein the structural equipment is constructed from Si-modified compositions with a concentration of 0.30 to 1.5 wt. % Si, and with a CE of less than 0.45, no preheat is required. In another embodiment with a CE of less than 0.63, PWHT is not required as CE diminishes, weldability improves. In another embodiment, the Si concentration is between 0.3 to 2.5 wt. % but the CE is >0.63, hence requiring PWHT. In one embodiment of PWHT, the as-welded or as formed steel equipment is heated above the $A_3$ temperature (into the austenite phase field) to approximately 1650 to 1750° F., water quenched to ambient then tempered by reheating, e.g., from 900 to 1300° F. In one embodiment of a Si-modified carbon steel composition, the material chemistry is balanced such that after welding with no preheat nor post weld heat treatment (PWHT), the resulting hardness in the material heat affected zone of the equipment does not exceed 248 Vickers hardness (HV10).

Performance of Equipment in Corrosive Environments

It is known that sulfur occurs in many species in sulfur-containing environment, and some sulfur compounds are more aggressive than others. Additionally, temperature is a factor in corrosion attacks in sulfur-containing environments, with corrosion rate increases significantly above 450° F., up to 800° F. due to the decomposition of sulfur compounds and formation of coke on metal surfaces. It is also observed that sulfur corrosion being more severe in gaseous phase. Additionally, flow rate and flow regime, e.g., turbulent flow, etc., also affect the corrosion rate due to higher shear stresses.

Structural equipment employing the Si-modified composition is particular suitable for use in sulfur-containing environments such as refineries, and at a high temperature of over 400° F., for use as pipes, pressure vessels, etc., and the like, for the containment of sulfur-containing hydrocarbons. In one embodiment, structural equipment constructed out of a composition with an added Si concentration of at least 0.25% experiences a corrosion rate of at least 25% less than the corrosion rate of equipment constructed out of the same compositions without the added Si. In another embodiment, the corrosion rate is at least 50% less than the corrosion rate of a similar composition without the addition of at least 0.25% Si.

In one embodiment of a carbon steel composition with a Si content between 0.30 to 1 wt. %, the equipment shows a corrosion rate of less than 15 mpy upon exposure to hydrocarbons saturated with a gas stream containing 10% $H_2S$ and 90% nitrogen at 600° F. In another embodiment for a steel composition having up to 2.5 wt. % Si, the corrosion rate is less than 10 mpy. In one embodiment of a carbon steel composition containing between 0.3 and 1 wt. % Si, the corrosion rate is less than 15 mpy upon exposure to hydrocarbons saturated with a gas stream containing 10% $H_2S$ and 90% nitrogen at 600° F. The rate is less than 10 mpy in another embodiment.

In one embodiment of a modified 5-Cr alloy steel composition containing between 0.3 and 2.5 wt. % Si, the corrosion rate is less than 10 mpy upon exposure to hydrocarbons saturated with a gas stream containing 10% $H_2S$ and 90% nitrogen at 600° F. In another embodiment with a 9-Cr alloy steel composition containing between 0.3 and 2.5 wt. % Si, the corrosion rate is less than 5 mpy.

Besides an improved corrosion performance, the equipment also shows a formation of a protective coating (scale), with a scale mass change of up to +1 mg/cm$^2$ for a Si concentration between 1 to 3.5 wt. %. For prior art equipment employing carbon steel, a negative value of mass scale is typically observed indicating spalling of the scale in a corrosive environment.

EXAMPLES

The following illustrative examples are intended to be non-limiting.

Examples 1-11

Coupons of samples including: a) type A 106 carbon steel, 5Cr steel (0.5 wt. Si), and 9 Cr steel (1 wt. % Si) as comparables; and a) Si-modified type A 106 carbon steel with sufficient Si added for concentrations of 0.50, 1, 1.5, 2.0, 2.5 and 2.7 wt. %; Si-modified 5Cr steel with 0.5-2 wt. %; and Si-modified 9 Cr steel with 2. wt. % Si. The coupons are of the same size and generally ¾ to 2" long, ½ to ¾" wide, and 1/16 to ⅛" thick. The coupons are immersed for 72 hours in heated glass cells at 600° F. containing a mineral oil solution saturated with a gas stream containing 10% $H_2S$ and 90% nitrogen.

After removal from solution, the samples are weighed and examined by optical and scanning electron microscopy for evidence of corrosion and corrosion product films. Energy dispersive X-ray (EDX) analyses are employed to determine qualitatively the compositions and corrosion product films. The samples are also examined for morphology of the corrosion attack at different locations of the samples, as well as the morphology and thickness of the surface films as a function of the location on the sample.

It is noted that for the Si-modified carbon steel coupons, there is no weight change in the coupon with Si concentration between 0.5 and 1.5 wt. %, and there is a slight weight change (0.5 mg/cm$^2$) for the coupon at 2.5 wt. % Si concentration indicating a build-up of a protective scale with a high Si concentration. The comparable carbon steel coupons show a weight loss of 1.5 to 2.5 mg/cm$^2$.

With respect to corrosion rate, the comparable carbon steel coupons show a corrosion rate of 20-30 mpy, compared to a corrosion rate of <=15 mpy for a Si-modified carbon steel with a Si content of 0.5 wt. % and a rate of ~10 mpy or less for a coupon with a Si content of 1-2.5 wt. %. It is further noted that the corrosion rate of the Si-modified carbon steel with Si content of 1-2.5% is comparable to the performance of the comparable 9 Cr-steel.

It is anticipated that the Si-modified 5-Cr steel coupon with a Si content of 1-2.5 wt. % to have a corrosion rate of 10 mpy or less, much better than the 15 mpy rate for the unmodified 5 Cr-steel coupon, and comparable to the rate of about 11 mpy rate for the unmodified 9 Cr-steel. It is further anticipated than the Si-modified 9-Cr steel with a Si addition of 0.5 to 2.5 wt. % to have a corrosion rate of 5 mpy or less and comparable to the corrosion rate of 12.5 Cr SS (410), which is much better than the corrosion rate of about 11 mpy for unmodified 9 Cr-steel.

Examples 12-30

A number of steel coupons of approximately 0.5" by 1" by 1/16" were prepared from metal sheets cast from elemental raw materials. The coupons were measured and weighted individually before and after the corrosion test. Steel compositions A36, A106, P11, P5, and P91 are commercially available compositions.

The coupons were tested for corrosion resistance in an autoclave, in a solution of Tufflo oil (napththenic) saturated with 10% $H_2S$+90% $N_2$, at 600° F. for 72 hours. After testing, the coupons were cleaned to remove the oil, observed, and weighed. The coupons were cleaned of any corrosion products, weighed, and corrosion rates were measured according to ASTM G1-03 (Reapproved 2011). Compositions and the results of the corrosion tests (CR: corrosion rate in mpy) are shown in Table 3:

TABLE 3

| Example | Fe* | C | Si | Mo | Al | Cr | Mn | Cu | CR mpy |
|---|---|---|---|---|---|---|---|---|---|
| A36 | bal | 0.12 | 0.08 | 0.02 | 0.038 | 0.16 | 0.53 | — | 27.44 |
| A106 | bal | 0.25 | 0.25 | — | 0.029 | 0.18 | 1.01 | — | 21.37 |
| P11 | bal | 0.08 | 0.59 | 0.47 | — | 1.17 | 0.46 | — | 16.25 |
| P5 | bal | 0.08 | 0.33 | 0.46 | — | 4.88 | 0.44 | — | 16.09 |
| P91 | bal | 0.12 | 0.34 | 0.92 | 0.01 | 8.4 | 0.44 | — | 11.90 |
| 12 | bal | 0.20 | 0.25 | 0.02 | 0.00 | 0.10 | 1.0 | 0.01 | 20.95 |
| 13 | bal | 0.23 | 0.51 | 0.02 | 0.01 | 0.11 | 1.0 | 0.01 | 16.71 |
| 14 | bal | 0.22 | 2.28 | 0.02 | 0.02 | 0.12 | 1.0 | 0.01 | 10.06 |
| 15 | bal | 0.23 | 0.33 | 0.49 | 0.01 | 0.11 | 1.0 | 0.01 | 12.37 |
| 16 | bal | 0.23 | 0.23 | 0.02 | 0.02 | 0.14 | 1.0 | 0.01 | 12.77 |
| 17 | bal | 0.18 | 1.07 | 0.00 | 0.01 | 0.05 | 0.45 | 0.11 | 12.2 |
| 18 | bal | 0.20 | 0.06 | 0.02 | 0.01 | 0.12 | 0.91 | 0.02 | 26.9 |
| 19 | bal | 0.20 | 0.12 | 0.02 | 0.01 | 0.11 | 0.92 | 0.02 | 14.1 |
| 20 | bal | 0.18 | 1.10 | 0.00 | 0.02 | 0.06 | 0.45 | 0.12 | 11.5 |
| 21 | bal | 0.2 | 0.90 | 0.03 | 1.02 | 0.66 | 0.40 | 0.02 | 12.95 |
| 22 | bal | 0.18 | 0.93 | 0.03 | 1.03 | 0.09 | 0.41 | 0.02 | 10.57 |

TABLE 3-continued

| Example | Fe* | C | Si | Mo | Al | Cr | Mn | Cu | CR mpy |
|---|---|---|---|---|---|---|---|---|---|
| 23 | bal | 0.22 | 0.25 | 0.03 | 1.00 | 0.66 | 0.39 | 0.02 | 13.71 |
| 24 | bal | 0.20 | 0.25 | 0.03 | 1.00 | 0.08 | 0.35 | 0.02 | 12.04 |
| 25 | bal | 0.17 | 0.23 | 0.03 | 0.00 | 0.56 | 0.37 | 0.02 | 14.13 |
| 26 | bal | 0.20 | 0.90 | 0.03 | 0.32 | 0.08 | 0.36 | 0.02 | 11.75 |
| 27 | bal | 0.20 | 0.91 | 0.03 | 0.37 | 0.61 | 0.41 | 0.02 | 13.52 |
| 28 | bal | 0.16 | 0.85 | 0.03 | 0.31 | 4.17 | 0.33 | 0.03 | 13.04 |
| 29 | bal | 0.20 | 0.87 | 0.03 | 0.31 | 4.16 | 0.33 | 0.03 | 12.15 |
| 30 | bal | 0.20 | 0.96 | 0.03 | 0.100 | 0.54 | 0.34 | 0.02 | 11.66 |

*bal = balance

Examples 31-35

The Examples with the commercially available compositions were repeated at different temperatures and with 100% $H_2S$ gas saturation. The results indicate that the corrosion rate increased as the temperature increased from 500° F. to 600° F., then peaked at approximately 650° F. and decreased at 700° F.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A method for forming a structural equipment, the method comprising:

providing a steel composition having chemical requirements as specified according to any of ASTM and API standards and with a Si content ranging from 0.30 to 3.5% by weight;

forming a structural equipment from the steel composition such that the structural equipment complies to at least one of the ASTM standards, API standards with respect to manufacture, dimensions and weight, mechanical properties, testing, and certification of the structural equipment; and wherein the structural equipment can contain, without corroding, hydrocarbons in sulfur containing environments operating at a temperature ranging from 400° F. to 1000° F., and wherein the structural equipment has a corrosion rate of 15 mpy or less upon exposure to hydrocarbons saturated with a gas stream containing 10% $H_2S$ and 90% nitrogen at 600° F. for 72 hours.

2. The method of claim 1, wherein the steel composition is modified for a Si content ranging from 0.30 to 1% by weight.

3. The method of claim 1, wherein the steel composition is modified by adding at least 0.25% Si to the Si chemical requirements specified in the standard.

4. The method of claim 1, for forming a structural equipment as a pressure vessel complying to at least one of ASME Boiler and Pressure Vessel Code, Pressure Equipment Directive of the European Union, Japanese Industrial Standard and Canadian Standard CSA B51 with respect to manufacture, dimensions and weight, mechanical properties, testing, and certification of the structural equipment.

5. The method of claim 1, for forming a structural equipment as a pipe for high temperature applications complying to at least one of ASTM A106 and ASTM A36 standards with respect to manufacture, dimensions and weight, mechanical properties, testing, and certification of the pipe.

6. The method of claim 1, wherein providing a steel composition having chemical requirements as specified according to any of ASTM and API standards comprises providing an alloy steel composition having chemical requirements as specified according to ASTM A335 Grade P-5 standard with 4.0 to 6.0% Cr, and modified by adding at least 0.25% Si to the chemical requirements for a Si content ranging from 0.75 to 2.5% by weight, and wherein wherein the structural equipment is suitable for applications having exposure to hydrocarbons containing at least 0.2 wt. % sulfur for at least 30% of the time, and operating at a temperature ranging from 400° F. to 1000° F., and wherein the structural equipment has a corrosion rate of 10 mpy or less upon exposure to hydrocarbons saturated with a gas stream containing 10% $H_2S$ and 90% nitrogen at 600° F. for 72 hours.

7. The method of claim 1, wherein providing a steel composition having chemical requirements as specified according to any of ASTM and API standards comprises providing an alloy steel composition having chemical requirements as specified according to ASTM A335 Grade P-9 standard with 8.0 to 10.0% Cr, and modified by adding at least 0.25% Si to the chemical requirements for a Si content ranging from 0.75 to 2.5% by weight, and wherein wherein the structural equipment is suitable for applications having exposure to hydrocarbons containing at least 0.2 wt. % sulfur for at least 30% of the time, and operating at a temperature ranging from 400° F. to 1000° F., and wherein the structural equipment has a corrosion rate of 5 mpy or less upon exposure to hydrocarbons saturated with a gas stream containing 10% $H_2S$ and 90% nitrogen at 600° F. for 72 hours.

8. The method of claim 7, wherein the an alloy steel composition is modified for a Si content ranging from 0.5 to 1.5% by weight.

9. The method of claim 7, wherein the an alloy steel composition is further modified for an Al content ranging from 0.9 to 2% by weight.

10. The method of claim 1, wherein providing a steel composition having chemical requirements as specified according to any of ASTM and API standards comprises providing a carbon steel composition having Si chemical requirements according to any of ASTM A537, ASTM A106 and ASTM A36 standards and modified by adding at least 0.05% Si to the Si chemical requirements specified in the standard.

11. The method of claim 1, wherein providing a steel composition having chemical requirements as specified according to any of ASTM and API standards comprises providing a carbon steel composition having Si chemical requirements according to any of ASTM A537, ASTM A106 and ASTM A36 standards and modified by adding at least 0.05% Si to the Si chemical requirements specified in the standard for a composition having as components in weight: up to 0.35% of C; 0.30 to 3.5% Si; up to 1.2% Mo; up to 1.35% Mn; up to 5% Al; less than 12.0% Cr; balance of Fe and unavoidable impurities.

12. The method of claim 1, wherein the method is for making an as-welded steel pipe, and wherein forming a structural equipment from the steel composition comprises:

forming a cast steel slab from the steel composition, the steel composition has as components in weight: up to 0.35% of C; from 0.30 to 3.5% Si; up to 0.15% Mo; up to 1.35% Mn; up to 5% Al; one or more elements selected from Cr, Cu, and Ni in an amount of up to 0.4% each; a total concentration of Cr, Cu, Mo, Ni, and V of up to 1%; balance of Fe and unavoidable impurities;

heating the steel slab to a temperature in excess of 2000° F.;

rolling a heated steel slab in a rolling mill to obtain a skelp having a desired thickness;

forming the skelp into a pipe having two side edges positioned in contact with one another; and welding the two side edges together to form an as-welded pipe;

wherein the as-welded pipe complies to at least one of ASTM and API standards with respect to manufacture, dimensions and weight, mechanical properties, testing, and certification;

wherein the as-welded pipe is for containing hydrocarbons in sulfur-containing environments operating at a temperature ranging from 400° F. to 1000° F.;

wherein upon exposure to hydrocarbons saturated with a gas stream containing 10% $H_2S$ and 90% nitrogen at 600° F. for 72 hours, the pipe has a corrosion rate of less than 15 mpy.

13. The method of claim 12 for making an as-welded steel pipe, wherein the steel composition contains 0.3% to 1% Si by weight.

14. The method of claim 12 for making an as-welded steel pipe, wherein the steel composition has a CE of less than 0.45.

15. The method of claim 1, wherein the method is for making an as-welded steel pipe complying to any of ASTM A537, ASTM A106 and ASTM A36 standards with respect to manufacture, dimensions and weight, mechanical properties, testing, and certification;

wherein the as-welded pipe is containing hydrocarbons in sulfur-containing environments operating at a temperature ranging from 400° F. to 1000° F.; and wherein upon exposure to hydrocarbons saturated with a gas stream containing 10% $H_2S$ and 90% nitrogen at 600° F. for 72 hours, the pipe has a corrosion rate of less than 15 mpy.

16. The method of claim 15, wherein the steel composition has a CE of less than 0.45.

17. The method of claim 15, wherein the steel composition has a CE of greater than 0.45 and less than 0.63.

18. The method of claim 1, wherein the method is for making a seamless steel pipe, and wherein forming a structural equipment from the steel composition comprises:

forming a billet from the steel composition, the steel composition having as components in weight: up to 0.35% of C; from 0.30 to 3.5% Si; up to 0.15% Mo; up to 1.35% Mn; up to 5% Al; one or more elements selected from Cr, Cu, and Ni in an amount of up to 0.4% each; a total concentration of Cr, Cu, Mo, Ni, and V of up to 1%; balance of Fe and unavoidable impurities;

subjecting the billet to a piercing operation to form a hollow shell;

rolling the hollow shell into a seamless steel pipe;

wherein the seamless pipe complies to at least one of ASTM and API standards with respect to manufacture, dimensions and weight, mechanical properties, testing, and certification; and wherein the seamless steel pipe is for use in sulfur-containing environments, and wherein upon exposure to hydrocarbons saturated with a gas stream containing 10% $H_2S$ and 90% nitrogen at 600° F. for 72 hours, the pipe has a corrosion rate of less than 15 mpy.

19. The method of claim 1, wherein the method is for making an as-welded steel pipe, and wherein forming a structural equipment from the steel composition comprises:

forming a cast steel slab from the steel composition;

heating the steel slab to a temperature in excess of 2000° F.;

rolling a heated steel slab in a rolling mill to obtain a skelp having a desired thickness;

forming the skelp into a pipe having two side edges positioned in contact with one another; and welding the two side edges together to form an as-welded pipe;

wherein the as-welded pipe complies to any of ASTM A537, ASTM A106 and ASTM A36 standards with respect to manufacture, dimensions and weight, mechanical properties, testing, and certification;

wherein the as-welded pipe is for containing hydrocarbons in sulfur-containing environments operating at a temperature ranging from 400° F. to 1000° F.; and wherein upon exposure to hydrocarbons saturated with a gas stream containing 10% $H_2S$ and 90% nitrogen at 600° F. for 72 hours, the pipe has a corrosion rate of less than 15 mpy.

20. The method of claim 1, wherein the method is for making an as-welded steel pipe, and wherein forming a structural equipment from the steel composition comprises:

forming a billet from the steel composition;

subjecting the billet to a piercing operation to form a hollow shell;

rolling the hollow shell into a seamless steel pipe;

wherein the seamless pipe complies to at least one of ASTM and API standards with respect to manufacture, dimensions and weight, mechanical properties, testing, and certification; and wherein the seamless steel pipe is for use in sulfur-containing environments, and wherein upon exposure to hydrocarbons saturated with a gas stream containing 10% $H_2S$ and 90% nitrogen at 600° F. for 72 hours, the pipe has a corrosion rate of less than 15 mpy.

* * * * *